US006491166B1

(12) United States Patent
Compton et al.

(10) Patent No.: US 6,491,166 B1
(45) Date of Patent: Dec. 10, 2002

(54) METHOD AND APPARATUS FOR EVACUATING SHRINK FILM PACKAGES

(75) Inventors: Stephen Floyd Compton, Spartanburg; David Wayne Grams, Greer, both of SC (US)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 09/716,584

(22) Filed: Nov. 20, 2000

(51) Int. Cl.[7] ..... B65D 33/01

(52) U.S. Cl. ..... 206/497; 53/434; 53/442; 383/103

(58) Field of Search ..... 53/434, 442; 206/484, 206/497, 522, 524.8; 383/100, 101, 103; 426/106, 124, 129

(56) References Cited

U.S. PATENT DOCUMENTS 3,968,620 A * 7/1976 Keltner ..... 53/434
3,983,258 A * 9/1976 Weaver ..... 206/497
4,548,852 A * 10/1985 Mitchell ..... 206/497
5,178,281 A * 1/1993 Enzu ..... 206/522
5,254,074 A 10/1993 Landers et al. ..... 493/213
5,272,856 A * 12/1993 Pharo ..... 53/434
5,447,235 A * 9/1995 Pharo ..... 206/522
5,544,752 A * 8/1996 Cox ..... 383/100
5,772,034 A * 6/1998 Lin ..... 206/522

* cited by examiner

*Primary Examiner*—Jim Foster

(57) ABSTRACT

A heat shrinkable film package and a method for packaging food and non-food products is disclosed which includes a valve through which the package is evacuated during the heat shrinking step of the packaging process. Employing the valve of the present invention precludes the need for puncturing the film prior to heat shrinking. Thus, a wide variety of food products may be packaged in a manner more typically reserved for non-food products.

20 Claims, 5 Drawing Sheets

METHOD AND APPARATUS FOR EVACUATING SHRINK FILM PACKAGES

FIELD OF THE INVENTION

The present invention is directed to heat shrinkable film packages, and specifically to a one-way valve for evacuating such packages during the heat shrinking step of the packaging operation.

BACKGROUND OF THE INVENTION

Heat shrinkable films are employed in packaging a wide variety of food and non-food items. Generally, most food products require a package which completely encloses the product. While some foods require packaging materials having oxygen barrier properties, nearly all foods require a complete, coherent covering which protects the underlying product from environmental contaminants.

Conversely, many non-food products are not particularly sensitive to exterior contamination. For non-food products such as games, compact discs, textiles, etc., the outer film overwrap merely serves as a dust cover or, as is particularly the case for software, evidence that the package has not yet been opened. In non-food products packaged in a heat shrinkable film, a hole or perforation is often provided in the film. The hole is formed in the film either prior to or during the packaging process to allow air trapped within the sealed film to escape during the heat shrinking step.

With a few minor exceptions, the presence of such perforation in food packages is not acceptable. Thus, food products must be packaged in a more complex shrink film packaging operation than that employed for packaging non-food products. Typically, food products require that the heat shrinkable packaging film is first formed into a pouch or bag into which the product is placed. The bag or pouch is then evacuated prior to sealing and heat shrinking. In addition to increased expense, such additional packaging steps provide an increased opportunity for film waste and packaging failure.

Accordingly, there is a need in the art for an apparatus and method which will allow for the packaging of food products in a simplified manner, similar to that employed in the packaging of non-food products, without leaving an opening which may result in contamination of the food and without leaving any void or opening that exposes the underlying portions of the food product to the atmosphere.

SUMMARY OF THE INVENTION

The present invention is directed to a shrink film package which includes a product, at least one web of a shrink film wrapped about the product, at least one seal defined in the shrink film enclosing the product, and a polymeric valve sealed to the film at the seal. The valve is comprised of a tube of film having a first end extending into the package, a second end extending out of the package, and an intermediate portion within the seal. The valve further includes an exterior surface and an interior surface, wherein the exterior surface comprises a sealable polymeric material whereby the intermediate portion of the exterior surface is sealed to the shrink film at the at least one seal and wherein the interior surface comprises a nonsealable material at least at the first end and the intermediate portion thereof.

The present invention is also directed to a method for packaging a product which includes the steps of a) wrapping the product in at least one web of a heat shrinkable film;

b) subsequently sealing the heat shrinkable film thereby enclosing the product;

c) providing a polymeric valve comprising a tube of film sealed to the heat shrinkable film at a sealed portion of the heat shrinkable film such that a first end of the valve extends into the area enclosing the product, a second end extends out from the heat shrinkable film, and an intermediate portion is contained within the sealed portion of the heat shrinkable film, the valve further comprising an exterior surface and an interior surface, the valve being sealed to the heat shrinkable film at the intermediate portion of the exterior surface thereof and the interior surface comprising a nonsealable material at least at the first end and the intermediate portion thereof; and d) heating the heat shrinkable film thereby shrinking the film about the product, whereby simultaneously with the heat shrinking step, air surrounding the product is vented through the polymeric valve.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

The present invention is directed to a shrink film package of the type typically employed for products such as board games and software. However, the present package lacks the perforation or perforations commonly found in such shrink film packages. Instead, the present package and packaging method employ a polymeric valve which serves the function of the perforation, i.e., providing a passage for trapped air to vent from the package during heat shrinking, without leaving a portion of the underlying product exposed. The present invention may best be understood from a review of the drawings which depict the preferred embodiment of the present packaging method and resultant package.

Figure 1:
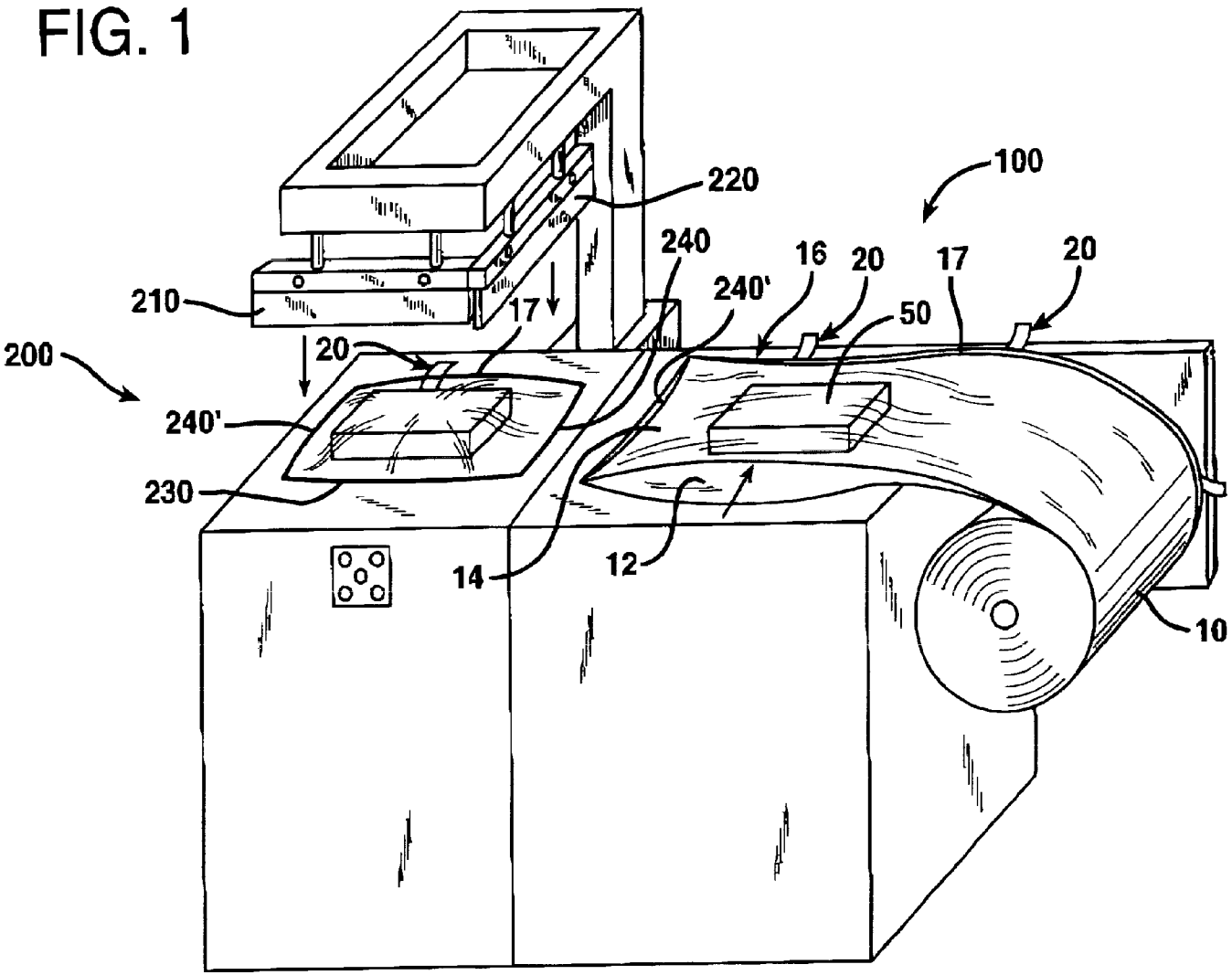
FIG. 1 is a perspective view of a loading and sealing station employed in a packaging operation in accordance with the present invention.

FIG. 1 illustrates a loading station 100 and a sealing station 200 of a typical shrink film packaging operation. Film roll 10 is positioned adjacent to the loading station 100 and includes lower web 12 and upper web 14. Each of the lower and upper webs is a heat shrinkable film. Preferably the two webs are substantially identical films, most preferably separate portions of the same film. Examples of heat shrinkable films appropriate for use in accordance with the present invention include heat shrinkable films supplied by Cryovac, Inc., including D-955™, MPD-2055™, BDF-2001™, and other bag and film products.

In a typical packaging process, edge 16 of the film would be a fold such that lower web 12 and upper web 14 would be two halves of a single, folded web of film. For purposes of the present invention it is preferred that edge 16 is a previously formed seal 17. As such, valve 20 is trapped within the seal, being sealed to webs 12 and 14, as is shown more clearly in FIGS. 2A and 2C. However, it is also within the scope of the present invention for edge 16 to be a fold and for valve 20 to be sealed to film webs 12 and 14 at a seal to be subsequently formed at sealing station 200. Such may be preferred when specific, selective placement of the valve or valves is desirable in order to accommodate the relative configuration of the product. However, it is more generally preferred that valves 20 (at least one for each package to be formed) have been positioned and sealed within seal 17 such that the operator at sealing station 200 need not position and seal the valves in place during the packaging operation.

Figure 2A:
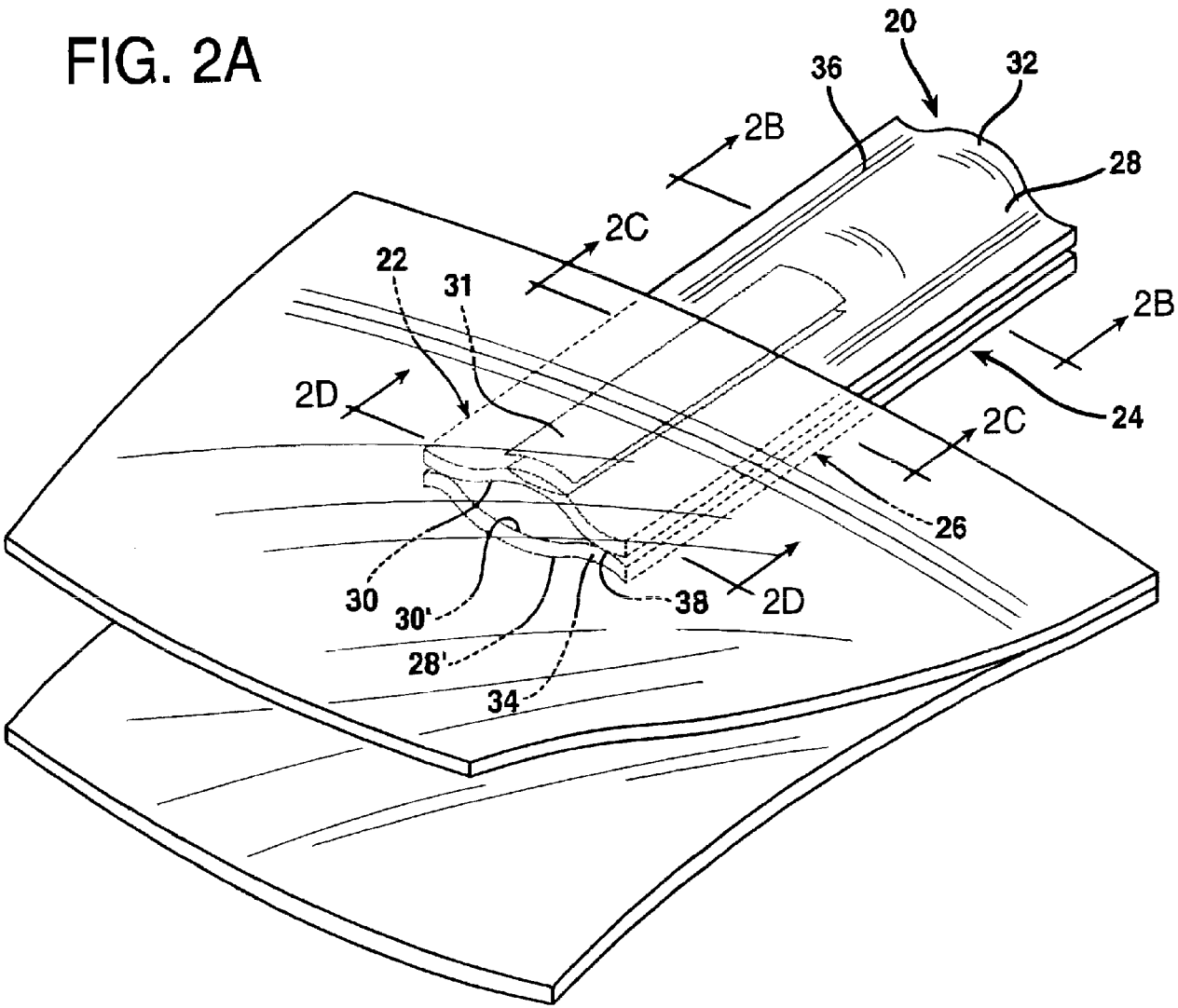
FIG. 2A is a perspective, partial cut-away view of the valve of the present invention.
Figure 2B:
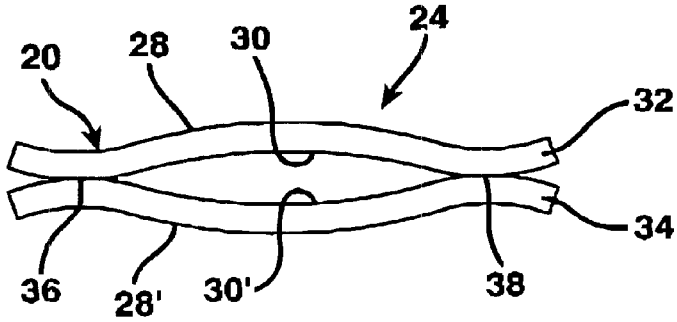
FIG. 2B is a cross-section of the portion of the valve which extends out of the package.
Figure 2C:
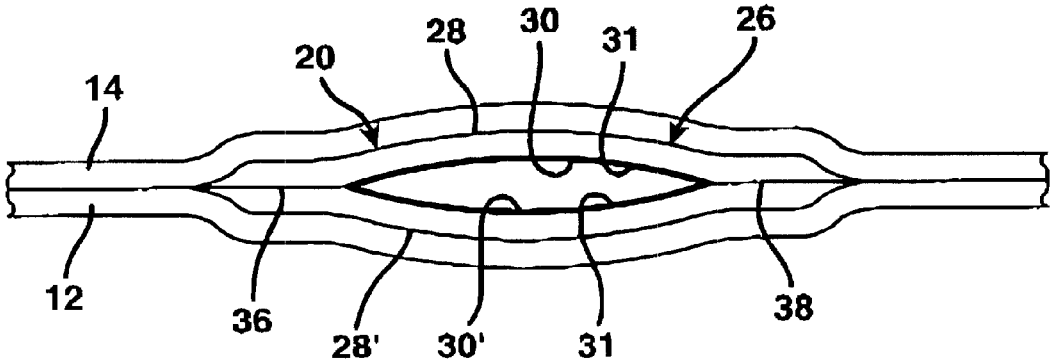
FIG. 2C is a cross-section of the portion of the valve which is sealed into an edge seal of the package.
Figure 2D:
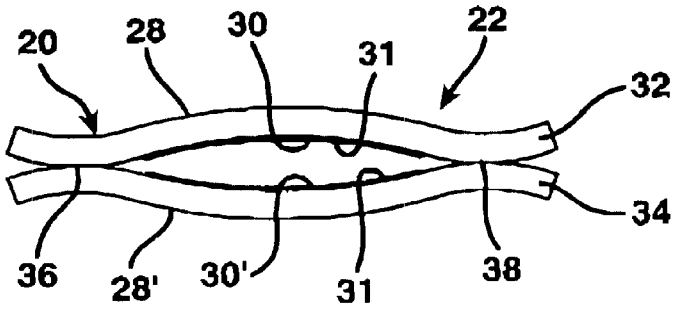
FIG. 2D is a cross-section of the portion of the valve which extends into the package.

Looking more closely at the valve 20 as shown in FIG. 2A and in cross-sectional views in FIGS. 2B–D, it is seen that valve 20 is tubular in cross-section and includes a first end 22 (shown in cross-section in FIG. 2D) which extends into the package being formed, a second end 24 (shown in cross-section in FIG. 2B) which extends out of the package being formed, and an intermediate portion 26 (shown in cross-section in FIG. 2C) which is sealed to webs 12 and 14 within seal 17. The tubular valve also includes an exterior surface 28 and an interior surface 30. Exterior surface 28 is sealable to webs 12 and 14 and is sealed to such webs at intermediate valve portion 26 as is shown in FIG. 2C. It is required, however, that interior surface 30 is not sealable to itself at the intermediate portion 26 of the valve.

Looking at FIGS. 2A–D it is seen that preferred valve 20 is formed of two film webs 32 and 34 which are sealed together at longitudinal seals 36 and 38. For such preferred valve the interior surface comprises surfaces 30 and 30' and the exterior surface comprises surfaces 28 and 28'. Surfaces 28 and 28' may be of identical or differing compositions but must be sealable to webs 12 and 14. Preferably surfaces 28 and 28' are essentially identical in composition. Similarly, interior surfaces 30 and 30' may be of identical or differing compositions but should be capable of forming longitudinal seals 36 and 38. Preferably, seals 36 and 38 are formed by heat sealing surfaces 30 and 30' to each other, although in an alternative embodiment seals 36 and 38 may be formed using an adhesive. In a most preferred embodiment film webs 32 and 34 are substantially identical monolayer webs of a blend of low density polyethylene and a metallocene catalyzed ethylene/α-olefin copolymer, although multilayer webs and webs of differing chemical compositions may be employed as long as the general requirements of sealability set forth herein are met.

It is preferred that a coating 31 which prevents sealing or adhesion between surfaces 30 and 30' is applied to surface 30, surface 30' or both at intermediate portion 26 in-board of seals 36 and 38. In a preferred embodiment the coating is a thermally resistive ink. A preferred ink for use as coating 31 in accordance with the present invention is Aqua-Tech 310 Pantone® 300C Blue sold by INX International Ink Company of Kansas City, Kans. Regardless of its composition, such coating preferably extends onto the interior surface of first end 22 in order to preclude undesirable tacking of that portion of the valve which extends into the package as is shown in FIG. 2D. Such coating also is preferred for a valve formed from a single, folded web having only one longitudinal seal.

Similarly, such coating may be employed for a valve which is a unitary, tubularly extruded tube, although as an alternative option the interior surface (30) of such valve may comprise a polymeric composition which is not self-sealable, or at least such a composition which is not self-sealable under the conditions employed for sealing the exterior surface to webs 12 and 14 at seal 17. Since the exterior surface is necessarily sealable to webs 12 and 14, providing such a non-self-sealable interior surface would require an at least two layer coextruded structure for such valve embodiment.

However, for a valve having at least one longitudinal seal, a seal-resistant coating disposed in-board of the longitudinal seal or seals is the preferred means for maintaining an opened, unsealed valve at the intermediate portion as shown in FIG. 2C; although other means are also within the scope of the present invention. For example, the longitudinal seal or seals may be formed under time, temperature, and/or pressure conditions which are more severe than those employed to form seal 17 such that a composition or compositions which is sealable under those extreme conditions but not under the conditions employed to form seal 17 is employed. Alternatively, for a folded valve with a single longitudinal seal, an at least two layer film web having an interior surface (30) which is not self-sealing under the conditions employed for forming seal 17 and an exterior surface (28) which is sealable to webs 12 and 14 and is also sealable to the material of interior surface 30 may be formed into a tube by means of a lap seal (inside to outside) rather than a fin seal (inside to inside).

An important consideration in determining the desirable means for rendering at least a portion of the interior surface of the valve non-self-sealing is the desirability of sealing the valve at end 24 which extends out of the package either during or after package formation. For many end-use applications it is acceptable that the entire interior surface of the valve is non-self-sealing. Depending on its polymeric composition, the valve generally will deform to at least some degree from the heat of the shrink tunnel. Thus, if the entire interior surface of the valve is non-self-sealing, the valve will be tightly closed but not sealed. For certain end-use applications, such as certain high gassing cheeses, it is desirable that the valve remains open after shrinking of the film webs in order to allow for post-packaging outgassing of the product. For such embodiment, the valve must be formed of a polymeric composition which can withstand the time and temperature conditions of the shrink tunnel without significant deformation. If the end-use application requires that end 24 of the valve is sealed, then preferably a non-sealing coating is applied to those portions which must remain non-sealed. For such applications the interior surface or surfaces of the valve at end 24 may comprise a polymeric material which can be sealed in a separate sealing step (for a valve formed from one or two webs), two distinct polymeric materials which can be sealed to each other in a separate sealing step (for a valve formed from two webs), or a polymeric material or materials which will self-weld during the heat shrinking step. The latter option is an acceptable alternative when a seal, but not necessarily a hermetic seal, is desired for the protruding portion of the valve.

Returning to FIG. 1, product 50 is loaded between webs 12 and 14 at loading station 100. The film and product are then indexed to sealing station 200. Seal bars 210 and 220 are impulse or heat sealing bars, both of which are well known in the art. Seal bar 210 forms seal 230 opposite and parallel to previously formed seal 17. Concurrently with forming seal 230, seal bar 210 also trims the excess film. Seal bar 220 forms a seal 240 and a seal 240' immediately adjacent to seal 240 and simultaneously cuts the film between the two seals such that the leading sealed edge of one package is being formed simultaneously with the formation of the trailing seal of the package ahead of it.

Figure 3:
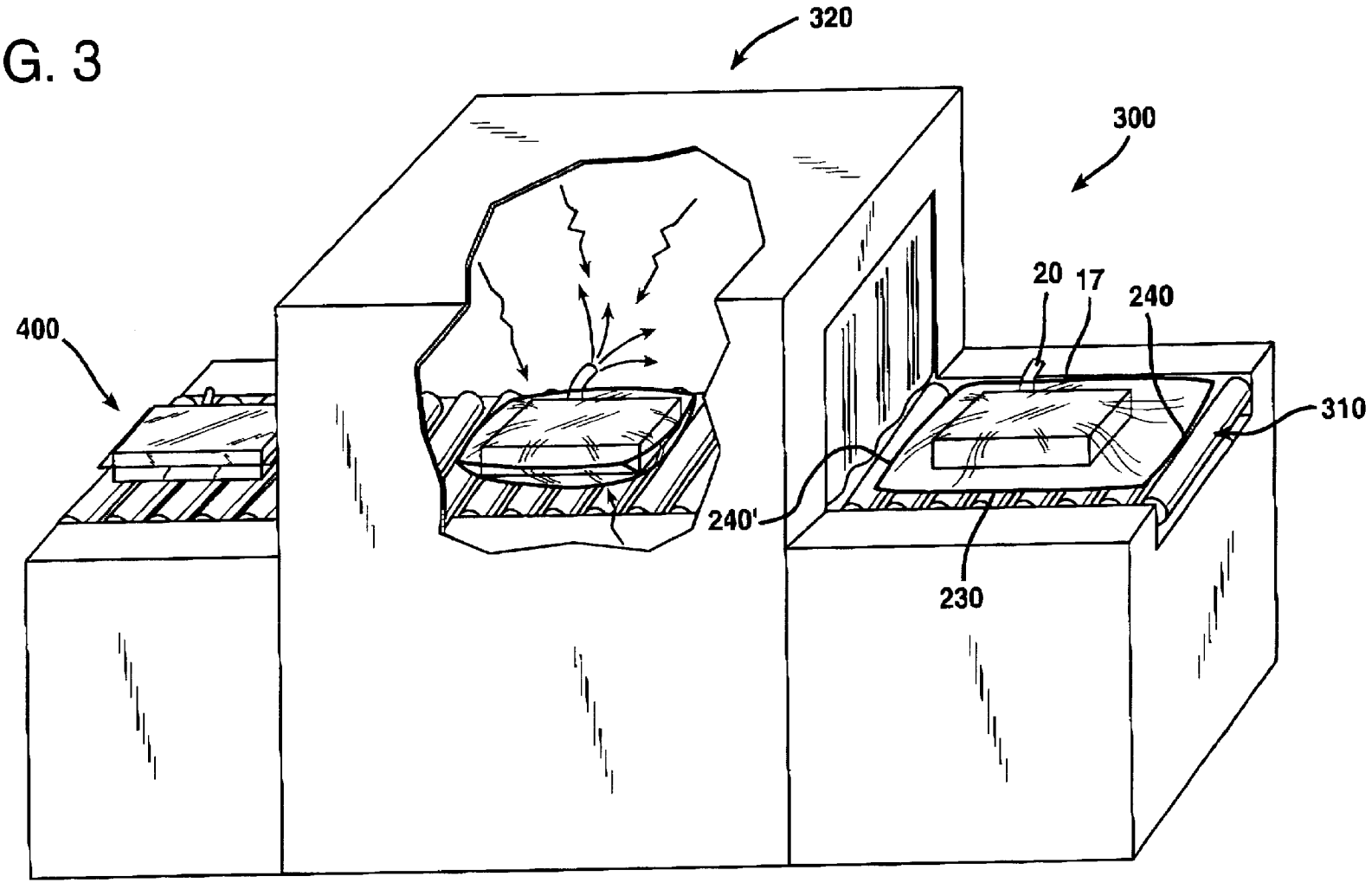
FIG. 3 is a perspective, partial cut-away view of a shrink tunnel employed in a packaging operation in accordance with the present invention.

The product 50 enclosed within film webs 12 and 14 by seals 17, 230, 240 and 240' is then placed on conveyor 310 of shrinking station 300 as is shown in FIG. 3. Within hot air shrink tunnel 320 the film is generally subjected to hot air at temperatures ranging from 200°F. to 400°F. for 0.5 to 20 seconds. The shrinking film forces the air trapped within the sealed webs out through valve 20 as is illustrated in the cut-away view of the shrink tunnel 320 in FIG. 3.

Figure 4:
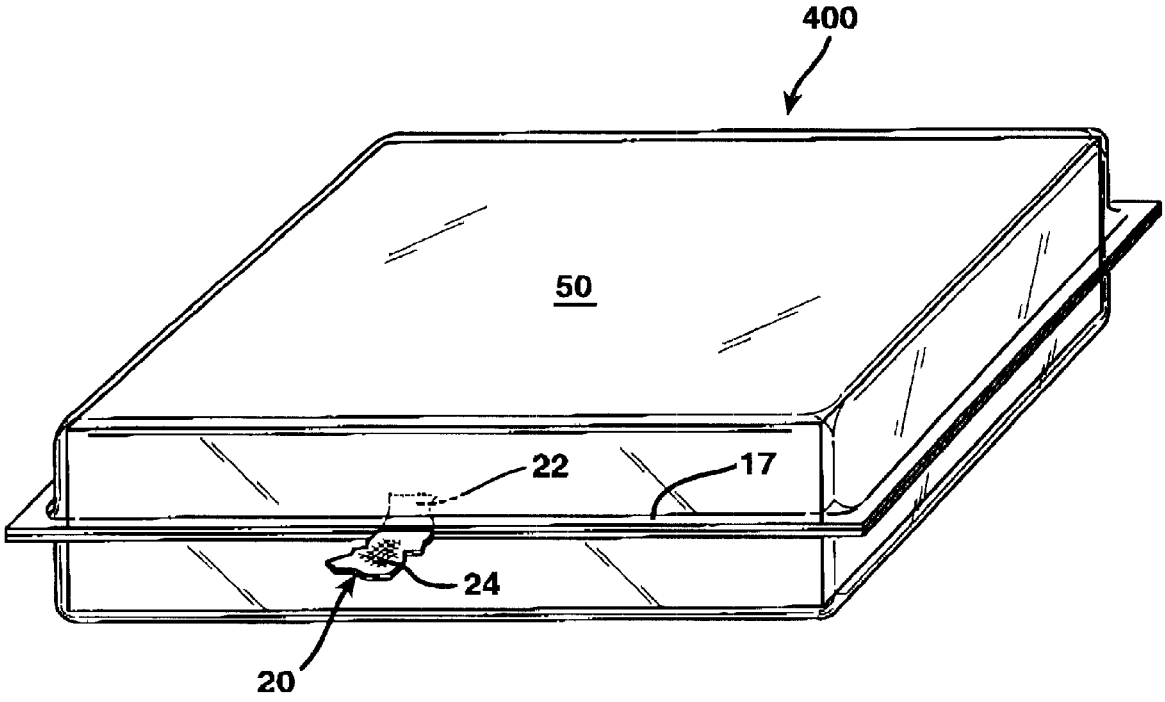
FIG. 4 is a perspective view of a shrink film package in accordance with the present invention.

After indexing out of the shrink tunnel, the package 400 is essentially complete, as is shown in FIG. 4. Optionally, the end 24 of valve 20 which extends out of the package may be sealed in a separate sealing step. As a further option, depending on the relative tearability of webs 12 or 14, outwardly extending valve portion 24 may serve as an easy-open pull-tab for opening the package.

Although the above-described packaging equipment is preferred for use in executing the present claimed method and producing the present claimed package, other types of packaging equipment and systems may be employed in accordance with the present invention. For example, curved seal bars forming packages which conform to the shapes of certain products may be employed. For such shaped packages it may be desirable to selectively place the valve or valves for evacuation of product cavities which might otherwise fail to vent. Such selective placement may be in a preliminarily formed seal or may be performed on-site during the packaging operation, substantially as described above. Alternatively, form-fill-seal equipment may be employed in the production of the initial sealed package prior to shrinkage. In addition to allowing for the packaging of flowable products, the use of form-fill-seal equipment would allow for the introduction of a desired treating gas to the product environment prior to venting during the shrink step.

Although the invention has been described with reference to its preferred embodiments, those of ordinary skill in the art may, upon reading this disclosure, appreciate changes and modifications which may be made and which do not depart from the scope and spirit of the invention as described above and claimed below.

We claim:

1. A shrink film package comprising:

a product;

at least one web of a shrink film wrapped about the product;

at least one seal defined in the shrink film enclosing the product; and a polymeric valve sealed to the film at the at least one seal, the valve comprising a tube of film having a first end extending into the package, a second end extending out of the package, and an intermediate portion within the at least one seal, the valve further comprising an exterior surface and an interior surface, wherein the exterior surface comprises a sealable polymeric material whereby the intermediate portion of the exterior surface is sealed to the shrink film at the at least one seal and wherein the interior surface comprises a nonsealable material at least at the first end and the intermediate portion thereof.

2. The shrink film package set forth in claim 1 wherein the interior surface of the polymeric valve further comprises a sealable polymeric material at the second end thereof and wherein the sealable polymeric material of the interior surface of the valve is sealed, thereby enclosing the product.

3. The shrink film package set forth in claim 2 wherein the sealable polymeric material at the interior surface of the valve comprises a self-welding polymer composition.

4. The shrink film package set forth in claim 2 wherein the seal of the sealable polymeric material at the interior surface of the valve comprises a heat seal.

5. The shrink film package set forth in claim 1 wherein the valve comprises a unitary tube.

6. The shrink film package set forth in claim 1 wherein the valve comprises two webs of film sealed longitudinally at outer edges thereby forming a tube.

7. The shrink film package set forth in claim 6 wherein the nonsealable material at the interior surface of the valve comprises a nonsealable coating on at least one of the two webs of film comprising the valve.

8. The shrink film package set forth in claim 1 wherein the valve comprises a single web of film folded longitudinally and sealed longitudinally at the outer edge opposite the fold, thereby forming a tube.

9. The shrink film package set forth in claim 1 wherein the second end of the valve extending out of the package further comprises a pull tab for opening the package.

10. A method for packaging a product comprising the steps of e) wrapping the product in at least one web of a heat shrinkable film;

f) subsequently sealing the heat shrinkable film thereby enclosing the product;

g) providing a polymeric valve comprising a tube of film sealed to the heat shrinkable film at a sealed portion of the heat shrinkable film such that a first end of the valve extends into the area enclosing the product, a second end extends out from the heat shrinkable film, and an intermediate portion is contained within the sealed portion of the heat shrinkable film, the valve further comprising an exterior surface and an interior surface, the valve being sealed to the heat shrinkable film at the intermediate portion of the exterior surface thereof and the interior surface comprising a nonsealable material at least at the first end and the intermediate portion thereof; and h) heating the heat shrinkable film thereby shrinking the film about the product, whereby simultaneously with the heat shrinking step, air surrounding the product is vented through the polymeric valve.

11. The method set forth in claim 10 further comprising the step of preliminarily sealing a portion of the heat shrinkable film prior to the step of wrapping the product, and wherein the step of providing the polymeric valve is performed during the preliminary sealing step, wherein the intermediate portion of the exterior surface of the valve is sealed to the heat shrinkable film at and within the seal formed during the preliminary sealing step.

12. The method set forth in claim 11 further comprising the step of selectively positioning the valve along the seal formed during the preliminary sealing step based on the relative configuration of the product.

13. The method set forth in claim 10 wherein the step of providing the polymeric valve is performed during step b), wherein the intermediate portion of the exterior surface of the valve is sealed to the heat shrinkable film at and within the seal formed during step b).

14. The method set forth in claim 13 further comprising the step of selectively positioning the valve along the seal formed during step b) based on the relative configuration of the product.

15. The method set forth in claim 10 wherein the interior surface of the polymeric valve further comprises a sealable polymeric material at the second end thereof.

16. The method set forth in claim 15 wherein the sealable polymeric material of the interior surface of the valve comprises a self-welding polymer composition such that the valve is sealed by the heat of the heat shrinking step subsequent to the venting step.

17. The method set forth in claim 15 wherein the sealable polymeric material of the interior surface of the valve comprises a heat sealable polymeric composition and further including the step of sealing the valve subsequent to the venting step.

18. The method set forth in claim 10 wherein the step of providing a polymeric valve comprises the steps of providing two webs of film;

coating a portion of at least one of the webs with a nonsealable material; and sealing the two webs together by forming longitudinal seals at opposed outer edges, thereby forming a flattened tube having an interior surface and an exterior surface, such that the nonsealable material is disposed on the interior surface of the tube.

19. The method set forth in claim 10 further comprising the step of exposing the product to a desired, treating gas and whereby simultaneously with the heat shrinking step the gas surrounding the product is vented through the polymeric valve.

20. The method set forth in claim 10 wherein subsequent to the heat shrinking step the product produces a gas and the gas is vented through the polymeric valve.

* * * * *

UNITED STATES PATENT AND TRADEMARK OFFICE

CERTIFICATE OF CORRECTION

PATENT NO. : 6,491,166 B1 
DATED : December 10, 2002
INVENTOR(S) : Steven F. Compton and David W. Grams It is certified that error appears in the above-identified patent and that said Letters Patent is hereby corrected as shown below:

Column 6,
Line 27, “e)” should be -- a) --
Line 29, “f)” should be -- b) --
Line 31, “g)” should be -- c) --
Line 44, “h)” should be -- d) --

Signed and Sealed this

Tenth Day of June, 2003

JAMES E. ROGAN
*Director of the United States Patent and Trademark Office*